United States Patent [19]

Koslow

[11] Patent Number: 4,520,773

[45] Date of Patent: Jun. 4, 1985

[54] FUEL INJECTION CLEANING AND TESTING SYSTEM AND APPARATUS

[75] Inventor: James R. Koslow, Westland, Mich.

[73] Assignee: Miller Special Tools Division Triangle Corporation, Stamford, Conn.

[21] Appl. No.: 650,345

[22] Filed: Sep. 13, 1984

Related U.S. Application Data

[63] Continuation of Ser. No. 358,519, Mar. 18, 1982, abandoned.

[51] Int. Cl.[3] ..... B08B 3/08; F02B 77/04

[52] U.S. Cl. ..... 123/198 A; 134/123; 134/169 A

[58] Field of Search ..... 123/198 A; 134/116, 134/123, 169 A

[56] References Cited

U.S. PATENT DOCUMENTS

| | | | |
|---|---|---|---|
| 1,240,977 | 9/1917 | Horn | 123/198 A |
| 1,451,157 | 4/1923 | Gerbig | 123/198 A |
| 1,871,340 | 8/1932 | Pielstick | 123/445 |
| 2,201,774 | 5/1940 | Hofele | 123/198 A |
| 2,645,379 | 7/1953 | Audia | 222/23 |
| 3,173,408 | 3/1965 | Brenneman | 123/119 |
| 3,211,377 | 10/1965 | Brenner | 239/1 |
| 3,224,684 | 12/1965 | Roosa | 239/533 |
| 3,318,096 | 5/1967 | Webb | 60/258 |
| 3,403,695 | 10/1968 | Hopkins | 137/240 |
| 3,575,145 | 4/1971 | Steiger | 123/478 |
| 3,589,388 | 6/1971 | Haneline, Jr. | 137/315 |
| 3,752,398 | 8/1973 | Svensson | 239/1 |
| 3,797,507 | 3/1974 | Jackson | 123/198 A |
| 4,059,123 | 11/1977 | Baitos et al. | 134/169 A |
| 4,061,504 | 12/1977 | Zall et al. | 134/95 |
| 4,082,565 | 4/1978 | Sjolander | 134/1 |
| 4,167,193 | 9/1979 | Magnus et al. | 134/169 A |
| 4,190,346 | 2/1980 | Hutson et al. | 354/324 |
| 4,197,140 | 4/1980 | Swan | 123/198 A |

FOREIGN PATENT DOCUMENTS

| | | | |
|---|---|---|---|
| 652338 | 3/1979 | U.S.S.R. | 123/198 A |

*Primary Examiner*—Ira S. Lazarus

*Attorney, Agent, or Firm*—Harness, Dickey & Pierce

[57] ABSTRACT

A method and apparatus for cleaning and testing the fuel injection system of a vehicle without disassembling the fuel injectors from the vehicle engine. The cleaning apparatus comprises a mechanism for feeding a solvent-fuel cleaning mixture into the fuel supplying system of the engine, a control system for the feeding mechanism and a series of connectors between the fuel injection system and both the feeding mechanism and the control system. The method includes connecting the feeding mechanism and the control system to the engine fuel injection system and running the apparatus to clean the fuel injectors on site without disassembling the fuel injectors from the vehicle engine. The testing apparatus may be performed statically or dynamically with the cleaning apparatus. The static testing mechanism involves disassembly of the fuel injectors from the engine. The dynamic testing apparatus comprises the cleaning apparatus, a flow meter, and added electrical controls in the control system including a selector switch to select the individual fuel injection valve to be tested. The dynamic testing method includes calibrating the apparatus flow meter, connecting the feeding mechanism and the control system to the engine fuel injection system and running the apparatus to measure the flow through the fuel injection valve by the flow meter.

24 Claims, 6 Drawing Figures

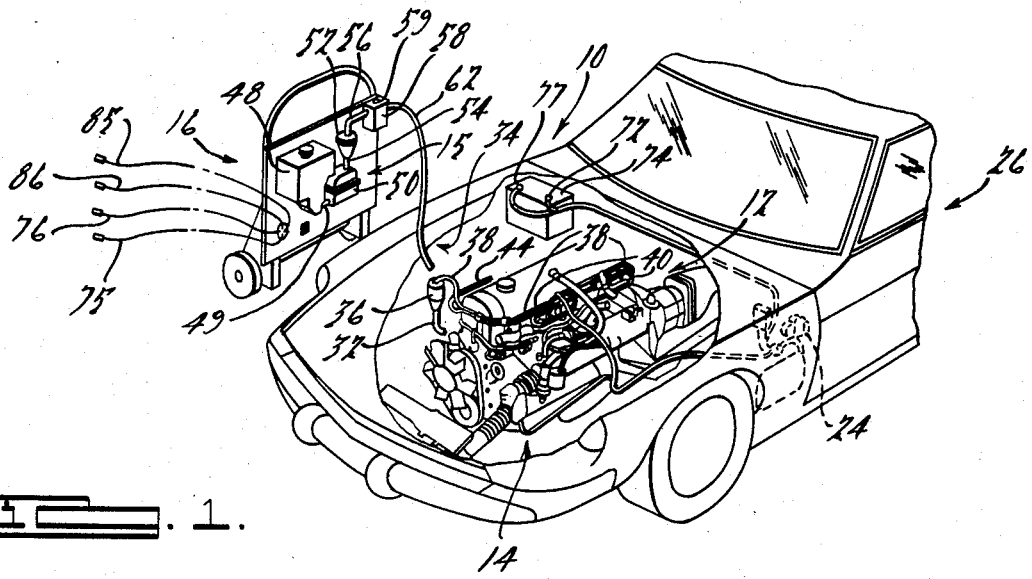
FIG. 1.
FIG. 2.
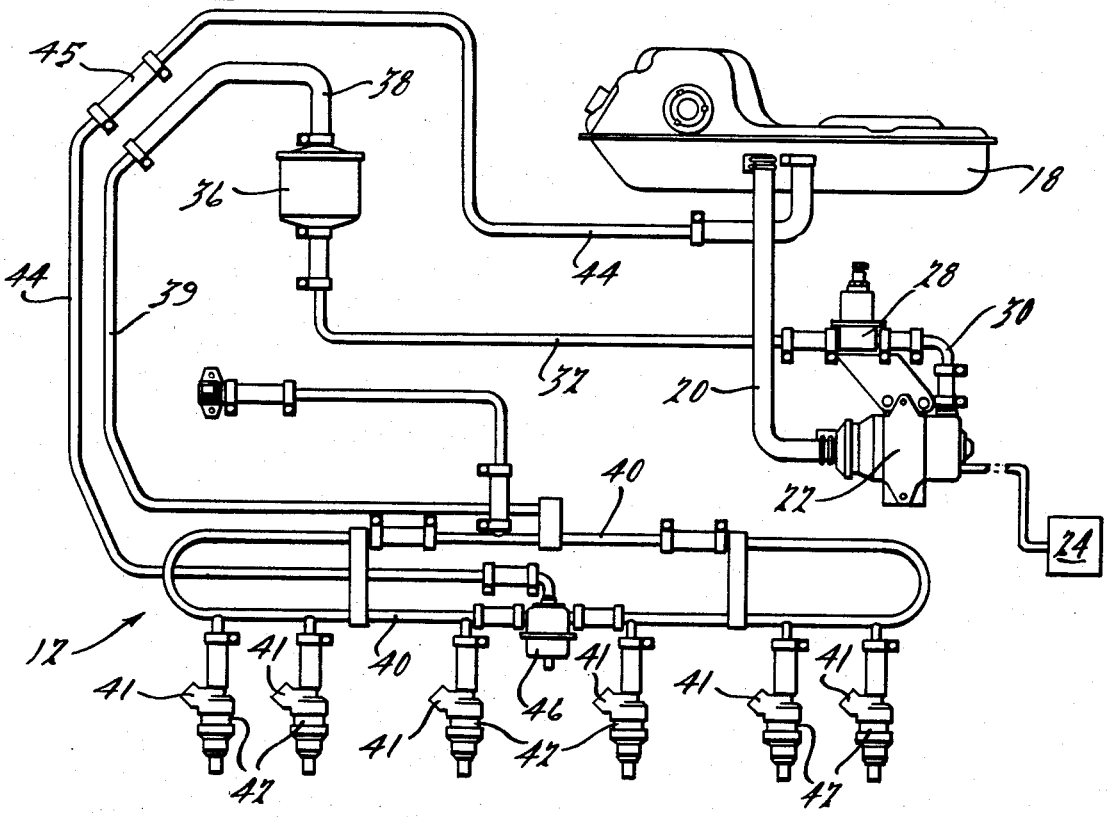

214
192
194
196
198
200
190
188
170
172
176
174
164
162
168
166
180
208
178
184
182
206
207
160
186
100
187
163
165
110
108
152
158
138
130
114
116
118
62
157
156
132
120
144
146
152
122
105
142
128
106
148
150
134
107
140
136
126
112
104
124
210
104

FUEL INJECTION CLEANING AND TESTING SYSTEM AND APPARATUS

This is a continuation of application Ser. No. 358,519, filed Mar. 18, 1982, now abandoned.

BACKGROUND AND SUMMARY OF THE INVENTION

The present invention relates generally to a device for cleaning the fuel injection system of an engine and measuring flow through individual injectors, and in particular to a fuel injector cleaner and injector flow measurement device for the engine of an automotive vehicle.

Fuel injection valves in vehicle engines, particularly the front portion of the fuel injection valves, are apt gradually to acquire an outer and inner deposit restricting the area of the fuel passage of the injection valve. Resulting modification of the function of the injector valve is particularly harmful for the type of injector valves which contain a reciprocatory sprayer needle unit and a solenoid for operating the same, since the fuel flow through the valve will vary with the area of the fuel passage. The restrictions formed by the deposits completely defeat the primary purpose of fuel injection valves to provide a more accurate metering of the quantity of fuel supplied to each of the cylinders of the engine during the suction stroke of the engine and a better control of the fuel/air weight relation in the combusted charge. Prior art methods and apparatus for deposit removal from a fuel injection valve, such as that shown in U.S. Pat. No. 4,082,565, have required removal of each fuel injection valve in order to clean the valve. Although less costly than replacement of the injection valves by a new set of valves when the valves no longer work properly, the labor cost of valve removal in itself is substantial.

Thus, the present invention has for one object to provide a satisfactory method for the removal of deposits from the fuel injection valves of a vehicle engine without removal of the valves. This object has also been disclosed in an application related by common assignment, U.S. Ser. No. 336,870, filed Jan. 4, 1982, now abandoned, by Angelito Reyes and Fred Abbott. Since correct proportionality of fuel to air is extremely important to motor power and efficiency in a fuel injection engine, it would appear that a need exists to provide a system for removing deposits from a fuel injection valve in a systematic and inexpensive manner. In such a manner, the fuel injection valves could be cleaned as part of the normal maintenance schedule without an exhorbitant labor cost or expensive replacement of parts. Thus, it is another object of the present invention to provide an in situ cleaning apparatus that can be attached directly to the fuel lines of the vehicle to inexpensively and systematically clean deposits from the fuel injection valves.

A further object of the present invention in minimizing labor costs is to provide a method and apparatus for the removal of deposits from a fuel injection valve at which the laborer does not have to remain observing the process, but instead the process may be automatically timed and automatically controlled. This object has also been disclosed in the above-referenced copending application.

Presently, in order to measure the flow through a fuel injector, the injector must be dismantled from the engine and tested on a test stand away from the actual working environment of the in situ location of the engine. Since such a test stand is expensive and uncommon, usually a service operation will only make an educated guess whether or not a fuel injector is defective (and which injector is defective) before replacement of a fuel injector. In one embodiment, the present invention has a cleaning apparatus which can be used to measure flow, and thereby effectiveness, of the fuel injector by disassembling the injector from the engine and measuring, without the need for a test stand, the downstream volume passing through the fuel injector for a given amount of time statically by collecting the flow by a suitable volumetric measuring device, such as a burette, and comparing the collected volume with that fuel or fuel mixture input into the fuel injector upstream of the fuel injector.

Another object of the present invention, however, is to provide a dynamic flow measurement device and method for each individual fuel injector without removing any of the fuel injectors from the engine environment in which the injectors are normally utilized. A further object is to incorporate this dynamic individual fuel injector flow measurement device into the same mechanism (and integrated into the same method) that cleans the fuel injectors, utilizing many of the identical components and method steps. The flow measurement device also has the object of being readily calibrated prior to each usage by the operator about to perform the flow measurement test.

Other objects and advantages of the instant invention will be apparent in the following specification, claims and drawings.

BRIEF DESCRIPTION OF THE DRAWINGS

FIG. 1 is an elevated perspective view of a vehicle having an engine with a fuel injection system to which an apparatus of the present invention is operably attached;

FIG. 2 is a schematic view of the fuel injection system of the vehicle of FIG. 1;

FIG. 6 is a side sectional view of FIG. 5.

DESCRIPTION OF THE PREFERRED EMBODIMENT

Figure 3:
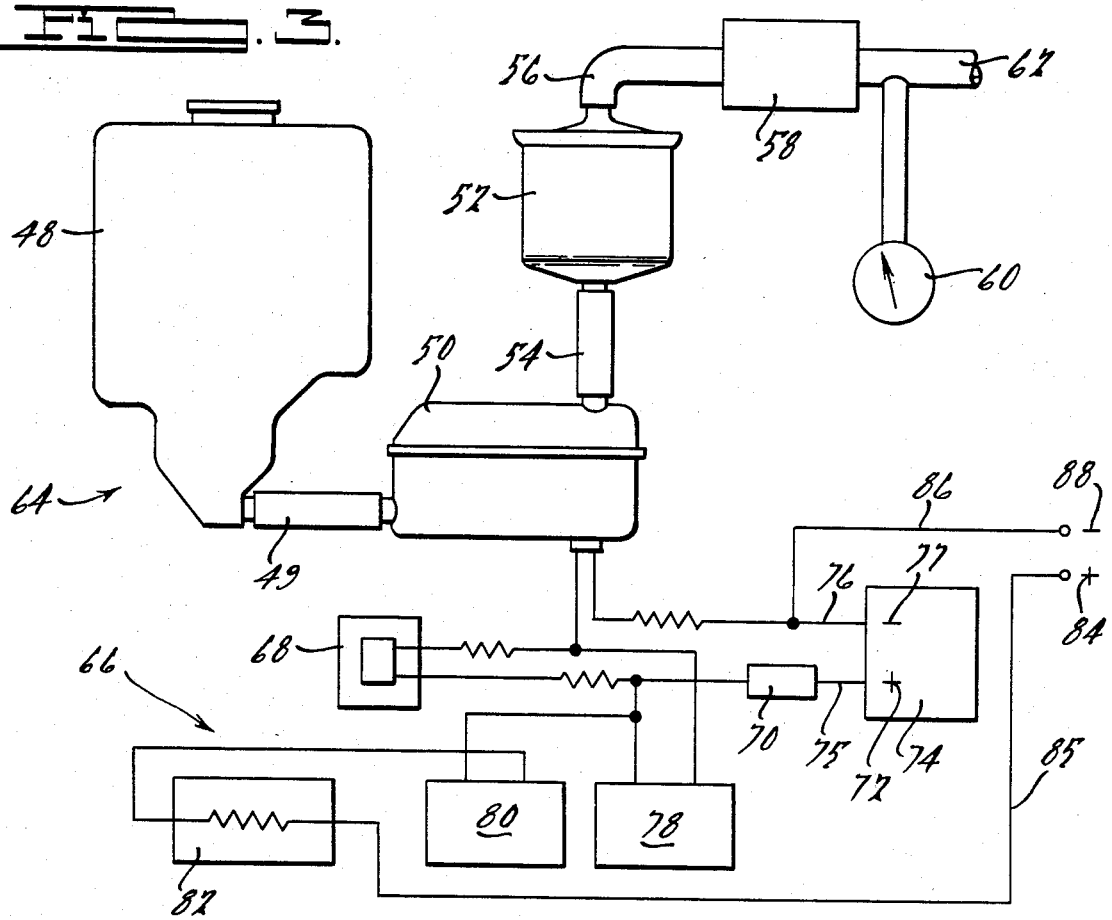
FIG. 3 is an elevated front view of an apparatus of the present invention as mounted on a movable cart.

Referring to FIG. 1, a vehicle 10 is shown having a fuel injection system 12 included and operably associated with an engine 14. A cart 16 is disposed adjacent the vehicle 10 upon which the control and pumping apparatus 15 of the present invention is disposed, as will be described hereafter. The fuel injection system 12, as illustrated schematically in FIG. 2, comprises a gas tank 18 from which a fuel feed pipe 20 communicates the gas tank with a fuel pump 22. The fuel pump 22 is controlled by a fuel pump relay mechanism 24 usually found within the passenger compartment 26 of the vehicle 10. The fuel pump 22 communicates with a pressure regulator 28 via fuel line 30. Fuel feed pipe 32 feeds fuel into the engine compartment 34 of the vehicle 10. Fuel feed pipe 32 communicates the fuel with a fuel filter 36 which in turn communicates on its opposite side via fuel pipe 38 with a distribution fuel pipe 40. The distribution pipe 40 communicates fuel to a series of fuel injectors 42 mounted on the engine 14. Each fuel injector communicates with one cylinder of the engine 14. Excess fuel is returned to the gas tank 18 via fuel return pipe 44 connected to the distribution fuel pipe 40 by a pressure regulator 46.

The apparatus 15 used for cleaning the fuel injection system 12, as illustrated schematically in FIG. 3, is mounted on a movable cart 16 (FIG. 1). A solvent tank 48 is mounted on the cart and communicates via fuel line 49 with an electric fuel pump 50 also mounted on the cart. The electric fuel pump communicates with a fuel filter 52 via fuel line 54. The downstream side of the fuel filter 52 has a fuel line 56 which communicates with a pressure regulator 58 and pressure gauge 60. The downstream side of the pressure regulator and pressure gauge communicates with a fuel line 62 which can be operably associated with the fuel injection system 12 of the vehicle 10 as will be described later.

The cleaning apparatus 15 is comprised of two parts, a fuel injection cleaning supply system 64 and a control mechanism 66 for the supply system 64, both mounted on the cart 16. The electric fuel pump 54 is controlled by a pump switch 68 which is mounted in series with a fuse 70 to the positive terminal 72 of the car battery 74 via line 75. Switch 68 and fuse 70 are mounted in series with a ground line 76 (from the negative battery terminal 77) and the fuel pump. Also in parallel with the pump switch 68 are two timers, a 10-minute pump timer 78 and a precision 1-minute injection timer 80. The injection timer may also be a 10-minute timer for convenience as a 10-minute test. Precision of the injection timer 80 is needed so that the technician can be positive that the injector is clean (measuring the exact amount of flow through the injector). The injection timer 80 is mounted in series through a dropping resistor 82 with the positive fuel injector control system terminal 84 via line 85. A return ground line 86 from the negative fuel injector control system terminal 88 is connected with the return ground line 76 from the battery 74 to the fuel pump 54. A conventional burette (not shown) is also included in the cart to be used for ancillary volumetric fuel injector testing as will be described later.

The service procedure for cleaning the fuel injectors with the apparatus of the present invention involves an initial step of preparing the fuel injector cleaner mixture. One can of fuel injector cleaner (16 ounces or 1 pint size), which comprises aromatic petroleum distillate and butyl cellosolve, is poured into the solvent tank 48. Two pints of gasoline are poured into the solvent tank 48 using the empty can of solvent for measuring and the solution is stirred. The operator then disconnects the fuel return line 44 (FIG. 2) from association with the gas tank 18 and plugs the return line 44 with an appropriate stop. The fuel pump relay mechanism 24 is then disabled and the fuel filter hose 38 is disconnected just above the fuel filter 36 (FIG. 2). The fuel feed hose 62 from the cart 16 is then connected to the fuel pipe 38 to operably associate the cart fuel supply system 64 with the fuel injection system 12 of the vehicle 10. The control mechanism 66 is then connected to the vehicle electrical system by connecting lines 85 and 86 to the fuel injector control system terminals and lines 75 and 76 to the battery 74. Alternatively, as will be described later, lines may be provided as a test harness to each individual injector instead of to the vehicle fuel injector control system.

At this stage the cleaning operation is set to be commenced. The fuel pump switch 68 is turned to the ON position. The vehicle engine is started and the operator should check for leaks in either the apparatus system or the vehicle fuel system at this time. The engine idle speed is set at a preselected speed (usually 1800 or 2000 rpm). The engine is run at idle until the cleaner tank 48 is empty. Then the pump switch 68 is turned to the OFF position. The engine 14 continues idling until the speed drops or fluctuates, indicating that the fuel filter and supply line are emptied of cleaner mixture. At this point the engine is shut off and the cleaning apparatus is disconnected. The fuel return line plug is removed and allowed to drain. Return pipe 44 is then reinstalled and the fuel hose 38 is reinstalled on the fuel filter 36. The fuel pump relay 24 is also connected. The engine is started and the vehicle fuel system is checked again for leaks.

The apparatus 15 of the present invention also has an additional capability which may be provided as an added step to be used with the above-described method just subsequent to the cleaning procedure for the fuel injectors or as an entirely separate use of the apparatus 15. The added capability comprises running a static volumetric test of the fuel injection system 12 by disconnecting the fuel injectors one by one after operably associating the cart system 64 with the fuel injection system 12 of the vehicle 10, measuring out a fixed amount of raw gas into the cleaner tank, running the engine such that the gas sprays out of the one nozzle into a burette, measuring the amount of liquid in the burette, and repeating the test for each nozzle. Multiplying the amount in the burette by six should give the original amount of raw gas and permit a fairly good estimate as to the amount of fuel going through each tested nozzle proportionate to the amount of fuel supplied to the nozzles.

Figure 4:
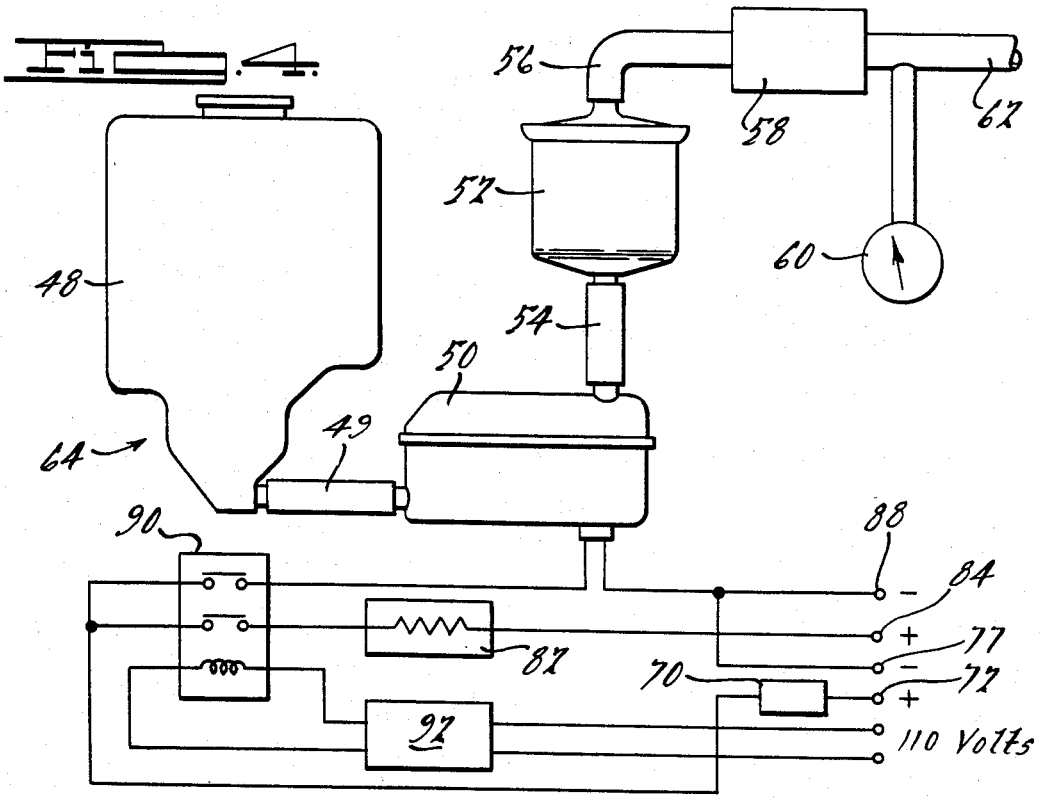
FIG. 4 is a view similar to FIG. 3 of an alternative embodiment of the present invention.

Referring to FIG. 4, an alternative embodiment of the fuel supply system 64 and control mechanism 66 on the cart 16 is illustrated. All of the components of the fuel system 64 are identical. The control mechanism 66, however, is altered using a 20 amp relay 90 in series with the fuse 70 instead of the pump switch 68. A 110 volt DC timer 92 is set across one set of terminals of the relay 90 to activate the relay 90 to start and stop the fuel supply system 64. A dropping resistor 82 is connected in series with the relay 90. All other aspects of the control mechanism 66 are the same as the prior described embodiment. When the timer 92 is set, the fuel pump will feed the solvent gas mixture into the fuel injection system and the fuel injector system will be operational for the amount of time that fuel is supplied. Thus the apparatus 15 can be left in operation and will shut itself off when the cleaning procedure has been performed.

The above two embodiments, both disclosed in assignee's co-pending Ser. No. 336,870, filed Jan. 4, 1982, now abandoned, by Angelito Reyes and Fred Abbott, may also be accomplished with a manual pump switch mechanism in place of the timers so that an operator may monitor the operation and time the operation himself in whatever manner is desired. A combination of both manual and automatic operations may also be readily accomplished within the control system 66.

Figure 5:
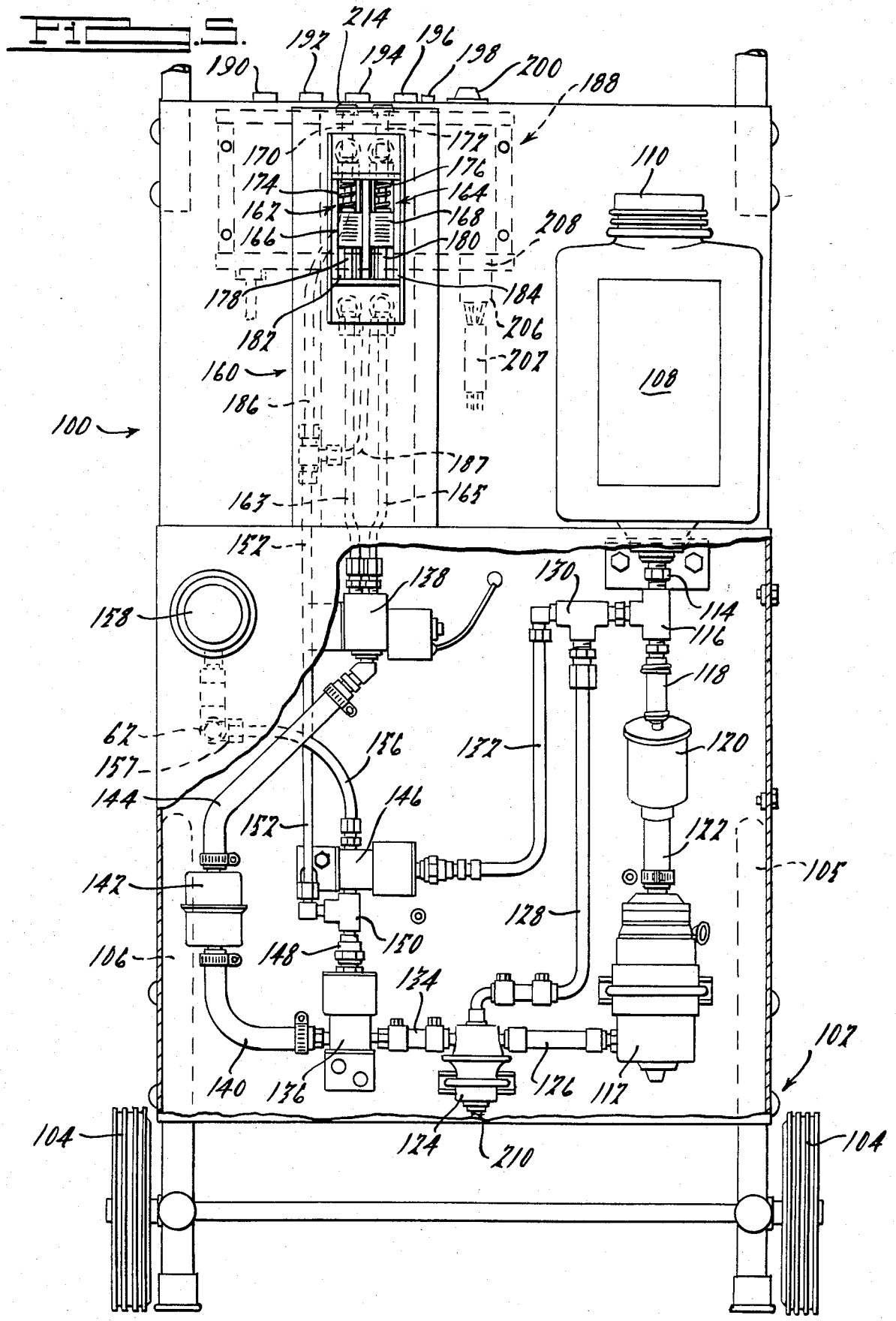
FIG. 5 is a view similar to FIG. 3 of an apparatus of the present invention as mounted on a movable cart having a mechanism for both cleaning and measurement of flow through the injectors without removal of the injectors from the vehicle.
Figure 8:
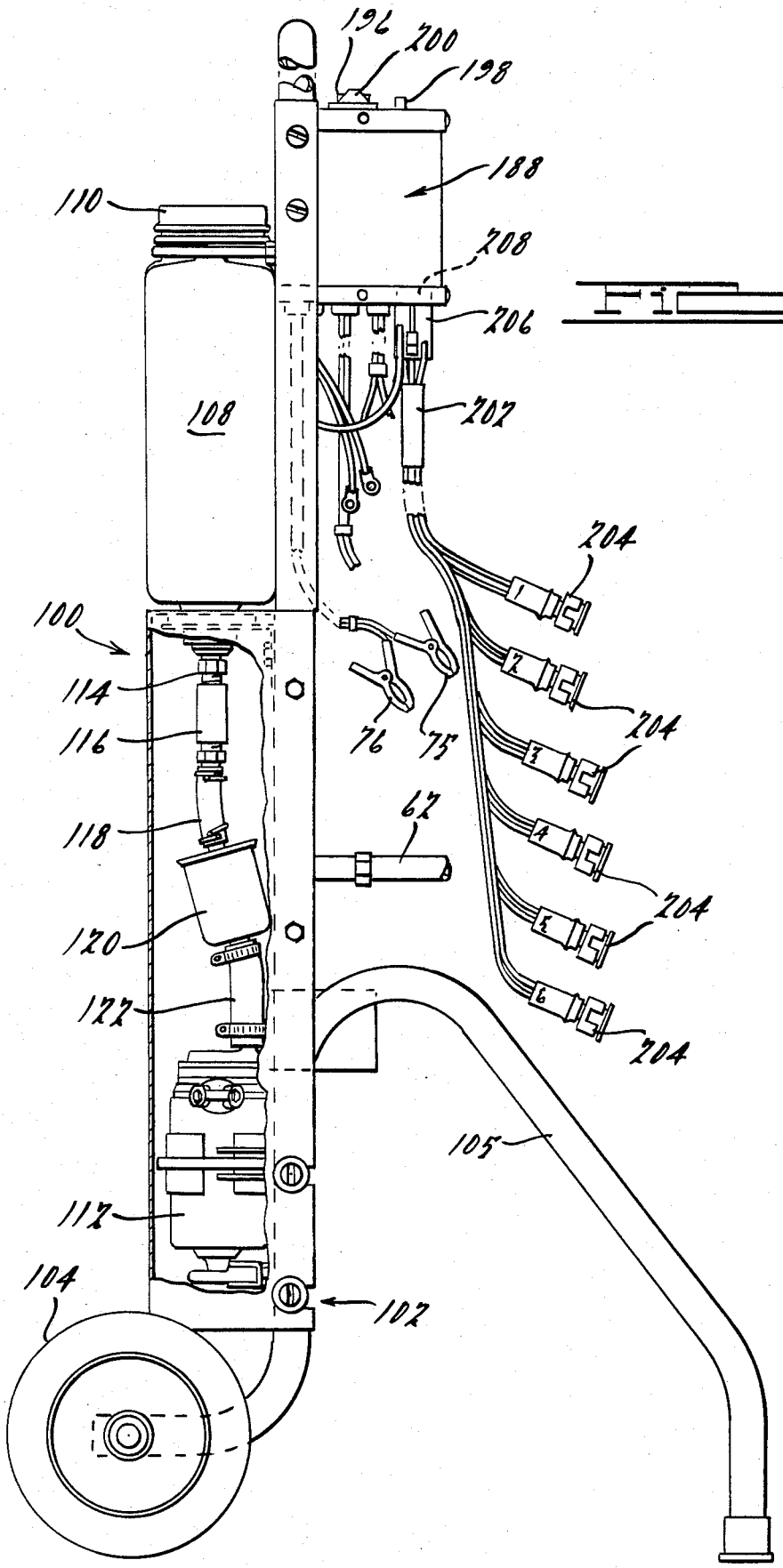

FIGS. 5 and 6 illustrate an embodiment of the present invention as claimed herein having usage as both a fuel injector cleaning device and fuel injector flow measurement device. The apparatus 100 is mounted on a movable cart 102, having wheels 104 and two legs 105, 106 to comprise a stand. A tank 108 having a removable top 110 is mounted on the cart 102 and communicates with an electric pump 112 also mounted on the cart 102 via fitting 114, branching fitting 116, conduit 118, fuel filter 120, and conduit 122. Downstream, the pump 112 communicates with a pressure regulator 124 via conduit 126. A return conduit 128 communicates the overflow of the pressure regulator 124 with a branching fitting 130 when pressure is decreased in the system by releasing flow through the regulator 124. The branching fitting 130 has one side communicating with branching fitting 116 and the other side communicating with a conduit 132. The pressure regulator 124 also communicates via conduit 134 with a first solenoid two-way control valve 136. The control valve 136 (when closed) communicates conduit 134 with second solenoid two-way control valve 138, via conduit 140, filter 142, and conduit 144. The first control valve 136 (when open) communicates conduit 134 with a third solenoid control valve 146 via fitting 148 and branching connector 150. Third solenoid control valve 146 also communicates via conduit 156 with a branching fitting 157 to communicate with both a pressure gauge 158 and the fuel feed hose 62, and via return line conduit 132 with branching fitting 130.

The second two-way solenoid control valve 138 controls flow to one of two separate meters of a flow meter panel 160, a first meter 162 to measure the flow through a standard injector on a standard engine and a second meter 164 to measure the flow through an injector utilized with a turbocharged engine or other high performance engine. The flow meter 162 and 164 are manufactured by Matheson Instruments of Hersham, Pa., and are referred to as a FM-1000, two tube flow meter (Product No. J2-1Y161-J619-J620). The second control valve 138 communicates with the meters 162 and 164 via lines 163 and 165, respectively. Each meter 162 and 164 has an individual calibration block 166 and 168 and an adjustment screw mechanism 170 and 172 (including biasing compression springs 174 and 176), along with each having a float 178 and 180, all disposed within a tapered glass tube 182 or 184. The adjustment screw mechanisms 170 and 172 permit the meters 162 and 164 to be individually calibrated by positioning the calibration blocks 166 and 168 in a desired position set against a standard as will be described later. The calibration blocks 166 and 168 each have a series of vertically spaced horizontal lines to define the high and low positions of the proper range and gradations between those high and low points. The second control valve 138 directs flow to one of the two meters 162 or 164 as desired. The output of the meter 162 or 164 communicates with return flow conduit 186 or 187 both of which feed into a conduit 152 which communicates with branching conduit 150 below the second control valve 146.

Referring to FIGS. 5 and 6, a control mechanism 188 is illustrated having five push button-controls 190, 192, 194, 196, and 198 and a selector dial 200. Button 190 ("Power") turns the apparatus 100 on and off. Button 192 ("Timer") controls a timer (set at ten (10) minutes in the preferred embodiment) in the control mechanism 188 similar to timer 78 of FIG. 3 or timer 92 of FIG. 4. Button 194 ("Standard") sets the control valve 138 to pass fluid through the flow meter 162 to be used with standard injectors for standard engines. Button 196 ("Turbo") sets the control valve 138 to pass fluid through the flow meter 164 to be used with high performance injectors in turbocharged or other high performance engines. Button 198 ("purge") purges the system of the apparatus 100 of air and runs the apparatus at a steady rate with the selected fuel injectors held open. The selector dial 200 has a setting for each of the number of cylinders to be tested (six in the preferred embodiment).

The control mechanism 188 includes the control mechanism 66 of FIG. 3 with some modification. A test harness 202 is included which includes six plugs 204, one plug 204 connected to each post 41 for each injector 42 on the engine. The plugs 204 are numbered from one (1) to six (6) to coincide with both the cylinder number in which the injector 42 is disposed to which the plug 204 is connected and the setting on the selector dial 200. The test harness 202 is interfaced with the control mechanism 188 via a plug 206 into a socket 208 in the control mechanism 188.

The service procedure for cleaning the fuel injectors 42 with the apparatus 100 is similar to that described with respect to apparatus 15 above. Clean gasoline is poured into the tank 108 to a lower fill line and the injection cleaner solvent is poured into the tank 108 until an upper fill line is reached. The tank cap 110 is then reinstalled on the tank 108. The fuel pipe 38 (FIG. 2) is subsequently disconnected from the fuel injector loop pipe 39, and the fuel feed hose 62 from the apparatus 100 is connected to the fuel injector loop pipe 39. At this point the fuel pipe 38 may be plugged or, alternatively, the fuel return pipe 44 may be disconnected at conduit 45, plugged on the side returning from the engine, and a U-tube placed across the fuel pipe 38 and the remainder of the return pipe 44 to close a loop between the supply pipe 38, return pipe 44 and the fuel tank 18.

A turnbuckle is loosely installed between the throttle control rod and a suitable hook-up point on the vehicle. Leads 75 and 76 are then properly connected to the vehicle battery 74. The "Power" and "Timer" buttons are depressed in sequence to activate the pump 112. The vehicle engine 14 is then started and the system is checked for leaks. When the engine speed has stabilized, the idle speed is set to 2000 rpm with the turnbuckle. The pressure gauge 158 should read 35 p.s.i. (as selected at the factory for the system and pre-set). If the pressure requires adjustment, the pressure regulator 124 may be adjusted via a manual control 210 to set the pressure up or down to the proper pre-selected level.

The fuel pump 112 will run for ten minutes (due to the timer) at which point the pump 112 will shut off and the engine 14 will stall. The engine ignition switch should be turned off and the turnbuckle removed.

The fuel feed hose 62 is then disconnected from the fuel inlet pipe 39 and the remaining solvent-fuel mixture is drained or otherwise discarded from the tank 108 (such as by restarting and running the car until the tank is empty). The power is turned off (depressing "Power" switch) and the leads 75 and 76 are disconnected. The fuel pipes 38, 39 and 44, 45 are reconnected. The engine 14 is then started and checked for leaks. At this point the first solenoid control valve 136 is mechanically reversed to be disposed in a normally closed position prior to commencing the service procedure for testing the fuel injector flow characteristics.

The service procedure for testing the fuel injectors of a fuel-injected vehicle engine with the apparatus 100 of FIGS. 5 and 6 begins with a calibration test. The tank 108 is filled with gasoline and the injector test harness 202 is plugged into the electrical control mechanism 188 via plug 206 inserted into socket 208. The fuel feed hose 62 is connected to one of two master injectors depending on the engine to be tested, the first a standard master injector and the second a master injector for a turbocharged or high performance engine. One plug 204 of the test harness 202 is also connected to the selected master injector. The apparatus 100 is turned on (by "Power" button 190), the master injector is positioned over the open fuel tank 108 (in order to contain the injector spray), and the timer 78 is actuated (by "Timer" button 192) to activate the pump 112 (and also open the third control valve 146 to communicate fitting 150 with conduit 156). The selector switch 200 is then positioned to match the selected plug 204 used from the test harness 202 (usually plug No. 1), and the "Purge" button 198 is depressed to purge air from the lines of the apparatus 100 and the selected master injector (overriding the pulse generator to provide a steady stream through the injector valve which is held open). The fuel feed hose 62 is preferably made of a transparent plastic material so that any air bubbles in the hose 62 may be observable.

Once the purge is complete, either the "Standard" or "Turbo" button (194 or 196) is depressed to activate a pulse generator in the electrical control mechanism 188, the pump 112, the second control valve 138 to select the flow meter 162 or 164 associated with the standard or turbo master injector being used in the calibration, and the first control valve 136 (now normally closed) to open the valve 136 to pump fuel through the flow meters 162 or 164. For the purposes of this description, a standard master injector will be used. With the master injector disposed in the open tank 108 (to collect the spray), the operator adjusts the flow meter calibration block 166 to the position of the float 178 by adjustment of the screw 214 of the adjustment mechanism 170 to place the block 166 (up or down) at the proper calibration level of the tube 182 as indicated on the master injector.

The proper calibration level is determined for each unit from a range developed by the manufacturer from testing the flow characteristics of a multitude of standard injectors (for the "Standard" calibration). Each standard and turbo master injector is secured to the apparatus 100 by chain or other attachment mechanism and serial number coded with the unit. Thus, the master injectors themselves may be recalibrated on an updated basis at intervals during periods of usage at a calibration test stand at the manufacturer's facility or a government facility.

Once calibration is made, the apparatus 100 is shut off. The master injector is disconnected from the test harness 202 and fuel feed hose 62. The fuel supply line 39 (FIG. 2) of the car is then connected to the fuel feed hose 62, the pipes 38 and 44 are looped and return pipe 44 is blocked from the engine side as described above in the cleaning procedure. The "Power" button 190 and "Timer" button 192 are depressed to activate the pump 112. Then the vehicle engine 14 is started to purge all of the injectors 42 and the fuel loop 40 of air. Subsequently, both the apparatus 100 and vehicle engine 14 are shut off.

The vehicle injector plugs are removed from the posts 41 of the injectors 42 and the plugs 204 of the test harness 202 are connected to all the posts 41 of the injectors. With the selector switch 200 in Position No. 1, the "Power" button 190 and "Timer" button 192 are depressed to start the apparatus and activate the pump 112. Then the "Standard" button 194 is depressed for approximately 20 seconds to activate the standard flow meter 162 (and valve 138), along with opening valve 136 to pump fuel through the flow meter 162. The float 178 will rise in the flow meter tube 182 to indicate flow. The No. 1 injector 42 is within the manufacturer's specifications for proper flow if the float 178 remains within the high-low range lines of the calibration block 166 as calibrated within the tube 182 (as set against the standard master injector).

The "Standard" button 194 is released, valve 146 returns flow to the tank 108, valve 136 stops flow through the flow meter 162, the selector switch 200 is turned to position No. 2, and the "Standard" button 194 is again depressed for approximately 20 seconds to activate the flow meter 162 and flow to the selected injector 42 (activating valves 136 and 146). The position of the float 178 is then evaluated. If the injector 42 does not cause the float 178 to be positioned within the range lines of the calibration block 166, the injector should be replaced. The above procedure is repeated until all of the injectors 42 have been tested (four, six, eight or whatever number exists).

Once the testing is complete, the apparatus 100 is turned off, the test harness plugs 204 and fuel feed hose 62 are removed, the fuel lines 38, 39 and 44, 45 and the electrical lines (vehicle plugs on injector posts 41) are reconnected. Then the engine is started and tested for leaks.

While it will be apparent that the preferred embodiments of the invention disclosed are well calculated to fulfill the objects above stated, it will be appreciated that the invention is susceptible to modification, variation and change without departing from the spirit of the invention herein described, or the scope of the subjoined claims.

I claim:

1. An apparatus for cleaning and testing the fuel injection valve system of a vehicle engine, said valve system including at least one electronically pulsed fuel injection valve operably secured to and associated with said engine, means for supplying fuel to said at least one valve, means for controlling said at least one electronically pulsed valve to feed fuel to said engine, and means for powering said controlling means, said apparatus comprising:

means for feeding a liquid into said fuel supplying means of said vehicle engine, comprising:
- an outlet conduit,
- means for storing a supply of said liquid,
- means separate from said fuel supplying means for pumping said liquid from said storing means to said outlet conduit, and
- means for communicating said storing means with said pumping means;

means for controlling said liquid feeding means, comprising:
- means for operating said at least one electronically pulsed fuel injection valve disposed in operable association with said vehicle engine,
- switch means for determining the commencement or cessation of operation of said feeding means, and
- means for operably associating said valve operating means and said switch means with said powering means;

means for operably associating said outlet conduit of said feeding means with said valve fuel supplying means and disabling said valve fuel supplying means to permit said feeding means to be the source of the fuel supply for said at least one fuel injection valve;

means for measuring the flow through one fuel injection valve at a remote location during operation of the injection valve while the injection valve is operably secured to and associated with said engine, said measuring means being integrated with said fuel supplying means;

a device for transporting said control, said communicating means, said pumping means, said storage tank, said outlet conduit and said measuring means to and from operable association with said engine; and valve means disposed on said transporting device for actuating said measuring means when said valve means is disposed in a first position and for bypassing said measuring means when said valve means is disposed in a second position, said measuring means being readily removable from operable association with said valve system by operably disassociating said outlet conduit operably associating means from said feeding means.

2. An apparatus in accordance with claim 1, further comprising timer means overriding said switch means for ceasing operation of said apparatus after a selected amount of time.

3. An apparatus in accordance with claim 2, wherein said timer means includes means for controlling the operation of said pumping means.

4. An apparatus in accordance with claim 3, wherein said timer means further includes means for controlling the operation of said fuel injection valve operating means.

5. An apparatus in accordance with claim 2, wherein said timer means includes means for controlling the operation of said fuel injection valve operating means.

6. An apparatus in accordance with claim 1, wherein said apparatus further comprises means for purging said feeding means which includes means for overriding said controlling means.

7. An apparatus in accordance with claim 1, wherein said measuring means further comprises means for filtering said mixture.

8. An apparatus in accordance with claim 1, wherein said feeding means further comprises means for regulating the pressure of said mixture downstream of said pumping means.

9. An apparatus in accordance with claim 8, wherein said feeding means further comprises a pressure gauge.

10. An apparatus in accordance with claim 1, wherein said valve system comprises a plurality of fuel injection valves disposed on one engine.

11. An apparatus in accordance with claim 1, further comprising means for calibrating said measuring means and at least one master injection valve against which said measuring means may be calibrated.

12. An apparatus for cleaning and testing the fuel injection valve system of an engine, said valve system including at least one electronically pulsed fuel injection valve operably associated with said engine, means for supplying fuel to said at least one valve, means for controlling said at least one valve to feed fuel to said engine, and means for powering said controlling means, said apparatus comprising:

a source of power;

means for feeding either a cleaning liquid or fuel into said fuel supplying means of said engine, comprising an outlet conduit, means for storing a supply of said liquid or fuel, means for pumping said liquid or fuel from said storing means to said outlet conduit, and means for communicating said storing means with said pumping means;

a control for said liquid or fuel feeding means, comprising means for operating said at least one electronically pulsed fuel injection valve disposed in operable association with said engine, switch means for determining the commencement or cessation of operation of said feeding means and said operating means, and means for operably associating said valve operating means and said feeding means with said source of power;

means for operably associating said outlet conduit of said feeding means with said valve fuel supplying means to supply liquid or fuel to said at least one fuel injection valve from said storing means of said feeding means;

means for measuring the flow through said at least one fuel injection valve during operation of the valve while the valve is operably secured to and associated with said engine, comprising flow meter means disposed at a location remote from said vehicle engine, first control valve means for permitting flow from said pumping means to said flow meter means, and second control valve means for permitting flow from said flow meter means to said at least one fuel injection valve; and a portable frame to which said feeding means, said control, and said measuring means are connected, and to which said flow meter means is mounted, to be transported to and from said engine.

13. An apparatus in accordance with claim 12, wherein said flow meter means comprises at least two separate flow meters and said measuring means further comprising third control valve means for selecting the flow meter to be used.

14. An apparatus in accordance with claim 12, wherein said measuring means including means for calibrating said flow meter means of each apparatus against at least one master fuel injection valve.

15. An apparatus for testing the fuel injection valve system of a vehicle engine, said valve system including at least one electronically pulsed fuel injection valve operably secured to and associated with said engine, means for supplying fuel to said at least one valve, means for controlling said at least one valve to feed fuel to said engine, and means for powering said controlling means, said apparatus comprising:

means for feeding fuel into said fuel supplying means of said vehicle engine, comprising:

an outlet conduit, a tank for storing a supply of said fuel, means for pumping said fuel from said storing tank to said outlet conduit, and means for communicating said storing tank with said pumping means;

a control mechanism for said fuel feeding means, comprising means for operating said at least one electronically pulsed fuel injection valve disposed in operable association with said vehicle engine, first switch means for controlling the commencement or cessation of operation of said feeding means and said apparatus fuel injection valve operating means, and means for operably associating said valve operating means and said manual switch means with said powering means;

means for operably associating said outlet conduit of said feeding means with said valve fuel supplying means and disabling said valve fuel supplying means to permit said feeding means to be the source of the fuel supply for said at least one fuel injection valve;

means for measuring the flow through an individual injector during operation of the testing apparatus while the injector is disposed on the engine, including second switch means for determining the commencement of flow measurement by said measuring means said measuring means being associated with and disassociated with said injector by means of the association or disassociation of said outlet conduit with said fuel supplying means; and a transporting device to which said fuel feeding means, said control mechanism and said flow measuring means are attached.

16. An apparatus in accordance with claim 15, wherein said measuring means includes multiple means for measuring fuel injector flow rates to be capable of measuring fuel injectors included in either standard or turbocharged vehicle engines as desired.

17. An apparatus in accordance with claim 15, wherein said valve system comprises a plurality of fuel injection valves disposed on one engine and said controlling means for said fuel feeding means includes means for selecting an individual fuel injector to be tested.

18. An apparatus in accordance with claim 15, wherein said manual switch means further includes timer means for controlling the length of time of operation of said fuel injection valve operating means and said fuel pumping means.

19. An apparatus in accordance with claim 15, wherein said apparatus further comprises means for calibrating said measuring means including a master injector calibrated to said apparatus and operable to be fed by said feeding means and controlled by said operating means of said controlling means and means for adjusting said means for measuring to properly calibrate said measuring means prior to testing injectors on an engine.

20. An apparatus in accordance with claim 15, wherein said switch means includes means for separately controlling the commencement or cessation of operation of said feeding means separate from said fuel injection valve operating means.

21. An apparatus in accordance with claim 15, wherein said feeding means further comprises means for filtering said mixture.

22. An apparatus in accordance with claim 15, wherein said feeding means further comprises means for regulating the pressure of said mixture downstream of said pumping means.

23. An apparatus in accordance with claim 15, wherein said feeding means further comprises a pressure gauge.

24. An apparatus for testing the fuel injector system of a vehicle engine, said injector system including at least one electronically pulsed fuel injector operably associated with said engine, means for supplying fuel to said at least one injector, means for controlling said at least one injector to feed fuel to said engine, and means for powering said controlling means, said apparatus comprising:

a source of power;

means for feeding fuel into said fuel supply means of said vehicle engine, comprising, an outlet conduit, means for storing a supply of said fuel, means for pumping said fuel from said storing means to said outlet conduit, and means for communicating said storing means with said pumping means;

means for controlling said fuel feeding means, comprising means for operating said at least one electronically pulsed fuel injector disposed in operable association with said vehicle engine, switch means for determining the commencement or cessation of operation of said feeding means and said injector operating means, and means for operably associating said injector operating means and said switch means with said source of power;

readily removable means for operably associating said outlet conduit of said feeding means with said injector fuel supplying means to supply fuel to said at least one fuel injector from said storing means of said feeding means; and means for measuring the flow through an individual fuel injector at a location remote from said injector during operation of the injector while the injector is operably associated with said engine, wherein said measuring means is associated and disassociated with said injector via the association and disassociation of said outlet conduit with said injector fuel supplying means.

* * * * *